US006129607A

United States Patent [19]

Hoeting et al.

[11] Patent Number: 6,129,607

[45] Date of Patent: Oct. 10, 2000

[54] SELF-RIGHTING REMOTE CONTROL VEHICLE

[75] Inventors: Michael G. Hoeting; Sean T. Mullaney, both of Cincinnati, Ohio

[73] Assignee: Bang Zoom Design, Ltd., Cincinnati, Ohio

[21] Appl. No.: 09/207,166

[22] Filed: Dec. 7, 1998

Related U.S. Application Data

[63] Continuation-in-part of application No. 08/497,519, Jun. 30, 1995, abandoned.

[51] Int. Cl.[7] ..... A63H 13/18; A63H 15/06

[52] U.S. Cl. ..... 446/396; 446/431; 446/440; 446/442; 446/448; 446/465; 446/466

[58] Field of Search ..... 466/396, 431, 466/440, 441, 442, 448, 465, 466, 468, 469, 470; 180/6.5, 65.6, 22; 446/433, 456, 460

[56] References Cited

U.S. PATENT DOCUMENTS

| | | | |
|---|---|---|---|
| 1,846,823 | 2/1932 | Westberg . | |
| 2,124,302 | 7/1938 | Lohr et al. . | |
| 2,832,426 | 4/1958 | Seargeant . | |
| 3,772,824 | 11/1973 | Terzian et al. . | |
| 4,299,301 | 11/1981 | Janin . | |
| 4,363,187 | 12/1982 | Shinohara . | |
| 4,449,323 | 5/1984 | Fisher . | |
| 4,601,674 | 7/1986 | Koizumi . | |
| 4,636,178 | 1/1987 | Oda . | |
| 4,666,420 | 5/1987 | Nagano . | |
| 4,710,147 | 12/1987 | Wakase | 446/464 |
| 4,767,376 | 8/1988 | Hanzawa . | |
| 4,894,042 | 1/1990 | Kamikawa . | |
| 5,322,469 | 6/1994 | Tilbor | 446/454 |
| 5,429,543 | 7/1995 | Tilbor et al. . | |
| 5,667,420 | 9/1997 | Menow | 446/433 |
| 5,667,421 | 9/1997 | Uetake | 446/470 |
| 5,919,075 | 7/1999 | Goerge | 446/437 |

FOREIGN PATENT DOCUMENTS

| | | | |
|---|---|---|---|
| 1423426 | 2/1976 | United Kingdom | 446/279 |

*Primary Examiner*—Bena B. Miller
*Attorney, Agent, or Firm*—Wood, Herron & Evans, LLP

[57] ABSTRACT

A self-righting remote control vehicle including a chassis, paired front and rear wheels rotatably mounted on the respective left and right sides of the chassis, and an upwardly tapered, generally pyramidal-shaped body mounted on the chassis. Each of the wheels has a peripheral portion which extends beyond the lower rear and side edge margins of the body such that when the vehicle is rolled over, a portion of at least one of the wheels normally engages the supporting surface. The vehicle further includes two separate drive systems for respectively rotatably driving the left and right pairs of front and rear wheels, and still further includes a remote control receiver for receiving control signals from a remote control transmitter and a controller for selectively independently controlling the separate drive systems responsive to the control signals received. The vehicle is operational in a rolled over condition wherein at least one of the front and/or rear wheels eventually engages the supporting surface and cooperate therewith to cause the vehicle to right itself during movement. According to one embodiment the body has the shape of a figure riding on an all terrain vehicle.

12 Claims, 7 Drawing Sheets

SELF-RIGHTING REMOTE CONTROL VEHICLE

CROSS REFERENCE TO RELATED APPLICATIONS

This Application is a Continuation-In-Part of U.S. application Ser. No. 08/497,519, entitled "Self-Righting Remote Control Toy Vehicle," filed on Jun. 30, 1995, now abandoned, which is incorporated herein by reference in its entirety.

FIELD OF THE INVENTION

The instant invention relates to remote control toy vehicles, and more specifically to a remote control toy vehicle with a self-righting capability.

BACKGROUND OF THE INVENTION

Self-righting and self-tipping toy vehicles have heretofore been known in the art. One common concept of the prior art has been to provide an arm which either pivots or rotates to engage the supporting surface and effect either righting, or tipping, of the vehicle. For example, the U.S. patents to Westberg U.S. Pat. No. 1,846,823, Shinohara U.S. Pat. No. 4,363,187, Fisher U.S. Pat. No. 4,449,323, Nagano U.S. Pat. No. 4,666,420 and Kamikawa U.S. Pat. No. 4,894,042 disclose such devices. While effective, these types of flipping and/or righting mechanisms are often mechanically complex, externally visible at certain times and are aesthetically unappealing when so visible.

SUMMARY OF THE INVENTION

The instant invention provides a self-righting remote control toy vehicle including a chassis, drivable and controllable front and rear wheels rotatably mounted on the respective left and right sides of the chassis, and a contoured body mounted on the chassis. In the embodiments set forth herein, the body has a generally pyramidal shape with an apex positioned on a longitudinal centerline of the body adjacent to a rear end of the body. According to one variation, the body has the appearance of a figure riding a vehicle, for example, a person riding an all terrain vehicle, and the head of the person is the apex.

Alternatively, the body could have a more hemispherical configuration, the important point being that the body is configured so that the vehicle will not normally remain in a position in which none of the wheels thereof contact the surface on which the vehicle is supported. Although there may be times, depending on the surface, when the vehicle is able to be precariously balanced in a position such that no wheels touch the ground, at least one of the wheels comes into contact with the ground upon actuation of the left or the right wheels. Furthermore, each of the wheels has a peripheral edge portion which extends beyond the lower edge margin of the pyramidal body such that when the vehicle eventually rolls over on any side, at least one of the wheels engages the supporting surface. The vehicle further includes two separate drive systems for respectively rotatably driving the left and right pairs of front and rear wheels, and still further includes a remote control receiver for receiving control signals from a remote transmitter and a controller for selectively independently controlling the separate drive systems responsive to the control signals received. More specifically, each of the drive systems comprises a reversible electric drive motor and a gear train coupling the drive motor to an associated pair of front and rear wheels for drivably rotating said wheels. In this regard, the toy vehicle further comprises a power source for energizing the first and second drive motors, a remote control receiver, and the controller for selectively independently energizing the individual drive motors. The vehicle is operational in a conventional manner for forward and rearward movement, and for turning, and maneuvering. The vehicle is further operational in a rolled over condition wherein the front and rear wheels which engage the supporting surface cooperate to move the vehicle when on its side. When the vehicle is moved in this manner, both the front and rear wheels engage the supporting surface, and cause the vehicle to wobble, or vibrate during movement thereof, thereby causing the vehicle to right itself during movement. On the other hand, if the vehicle comes to rest in a position in which only one wheel contacts a supporting surface of the vehicle, the one wheel will cause the vehicle to spin about the contact point between the vehicle body and the supporting surface until the vehicle rights itself.

Accordingly, among the objects of the instant invention are: the provision of a self-righting remote control toy vehicle; the provision of a self-righting remote control toy vehicle having paired front and rear wheels which are driven in unison by a common drive system, and the provision of a self-righting remote control toy vehicle having a contoured self-righting body and further having wheels wherein the peripheral edge portions of the wheel extend beyond the lower edge margin of the body such that at least one of the wheels normally engages the supporting surface in any rolled over position.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION

Figure 2:
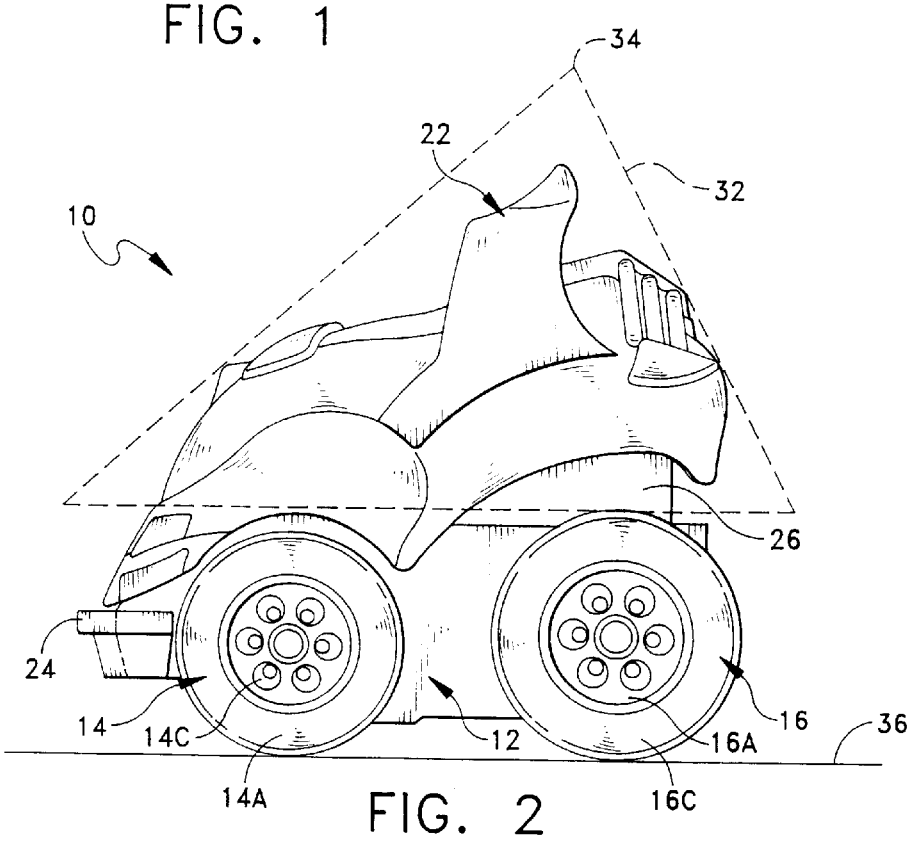
FIG. 2 is a side view of the vehicle shown in FIG. 1.
Figure 3:
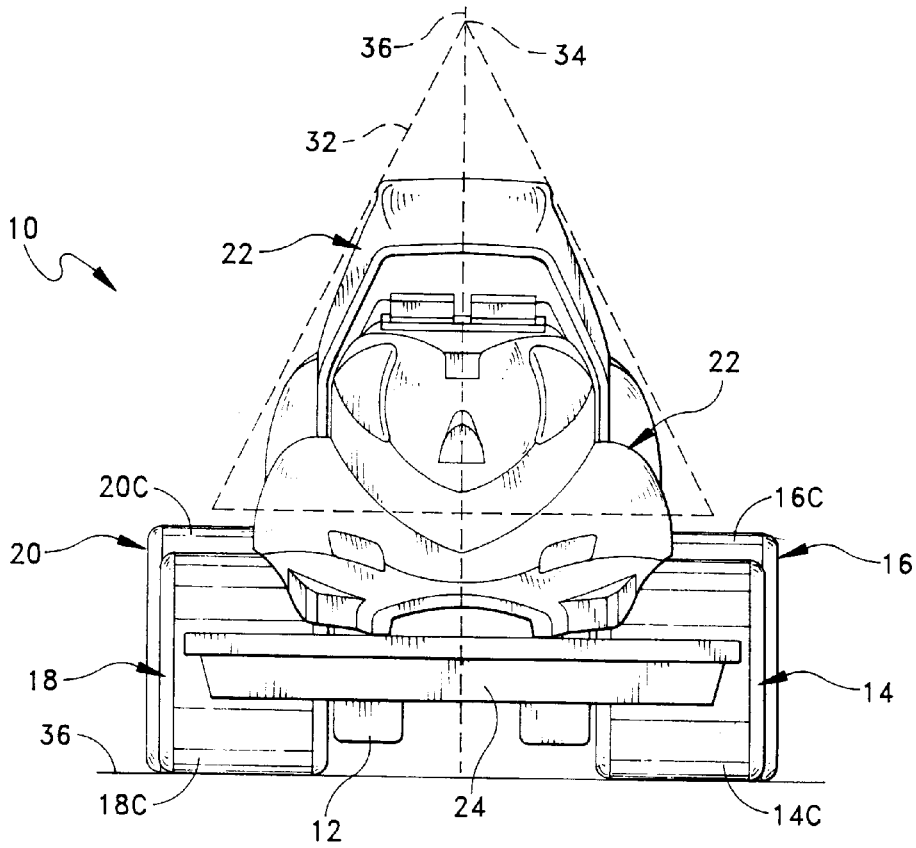
FIG. 3 is a front view of the vehicle shown in FIG. 1.
Figure 4:
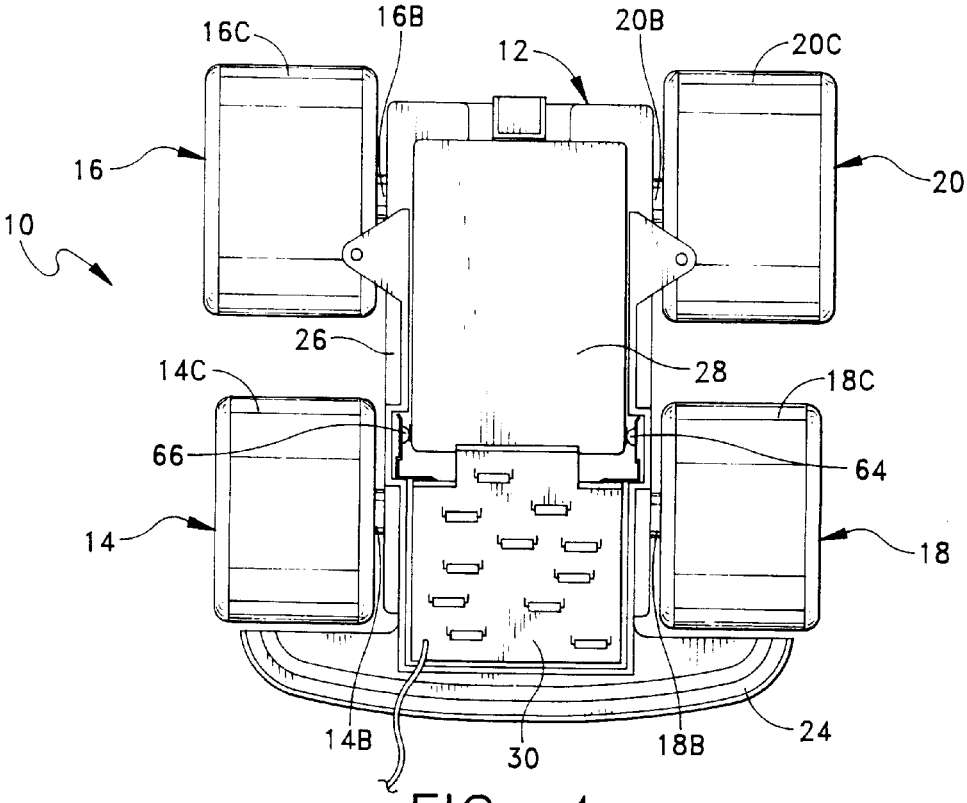
FIG. 4 is a top view of the vehicle shown in FIG. 1 with a body portion of the vehicle removed to expose the chassis, power source and the remote control electronics.
Figure 5:
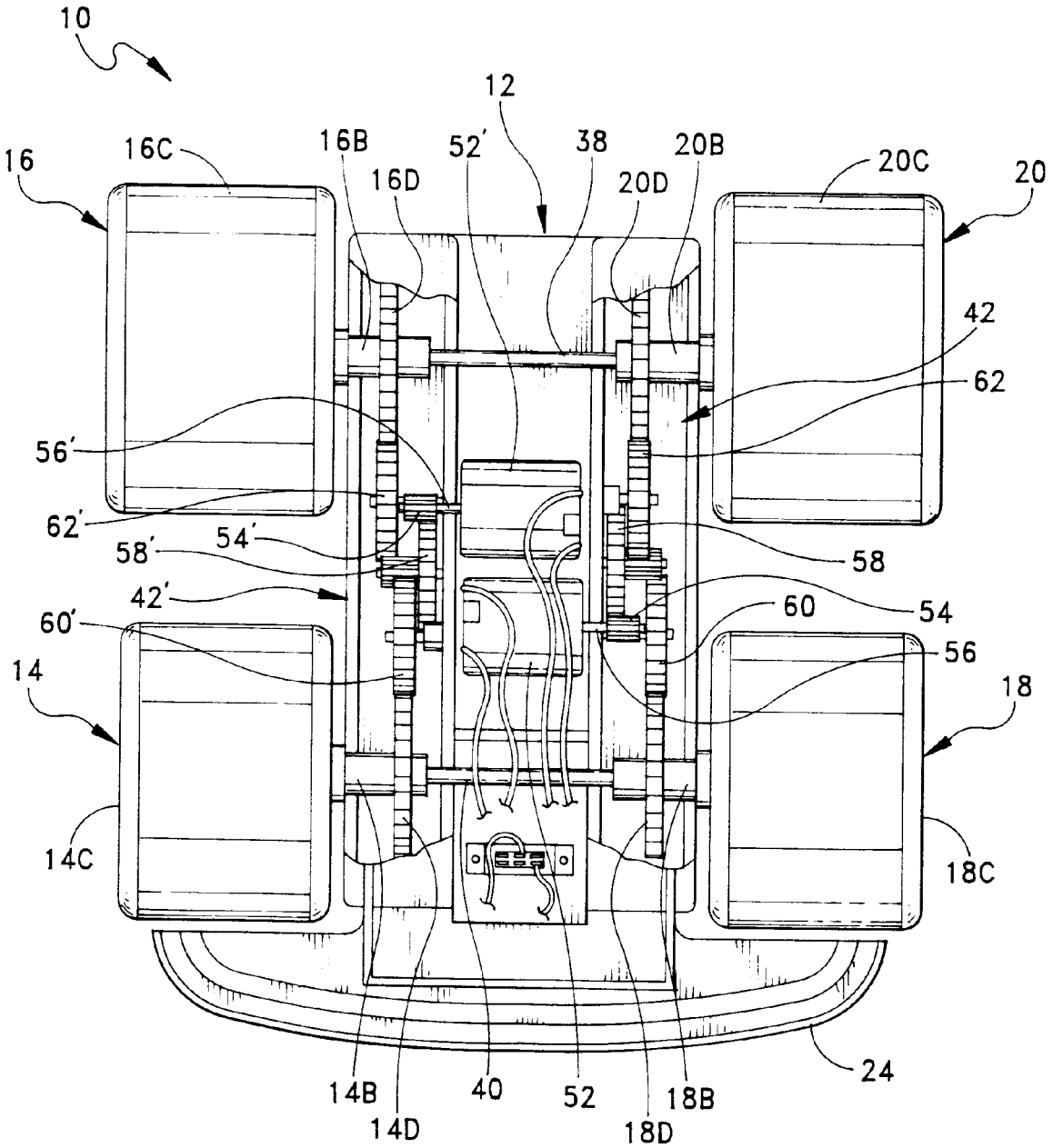
FIG. 5 is a fragmentary bottom view of the vehicle shown in FIG. 1, with the casing portions broken away to show the drive motors and gear trains.
Figure 6:
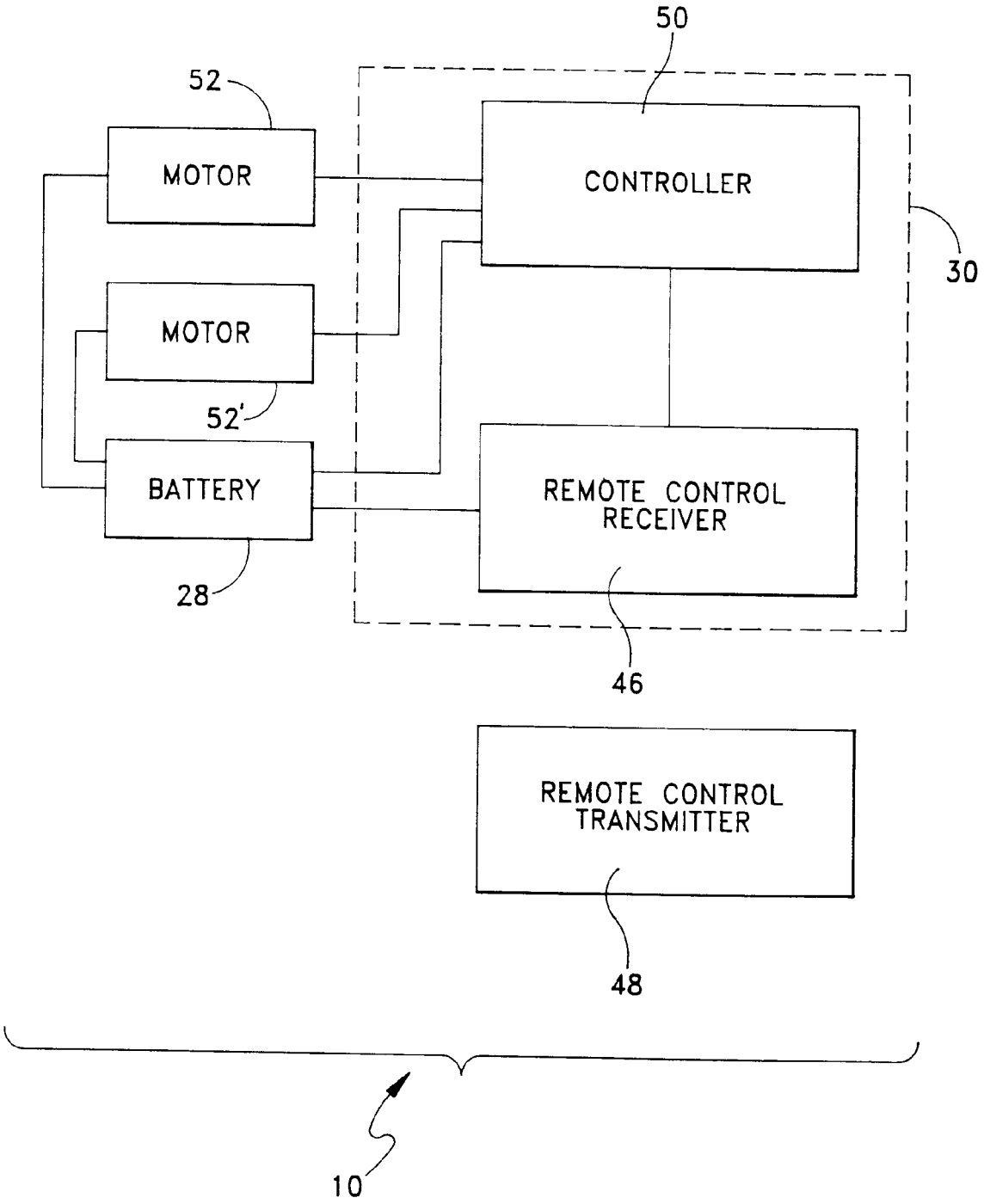
FIG. 6 is a schematic view of the electrical controls for a self-righting remote control vehicle in accordance with the invention.

Referring now to the drawings, a self-righting remote control toy vehicle of the instant invention is illustrated in FIGS. 1–12. The vehicle of the first preferred embodiment, including a body in the shape of a truck, is shown in FIGS. 1, 2, 3, 7 and 8. The vehicle of the second preferred embodiment, including a body in the shape of a figure riding an all terrain vehicle, is shown in FIGS. 9–12. FIGS. 4–6 are generic to both preferred embodiments. As will hereinafter be more fully described, the instant invention relates to a vehicle which is provided with a novel body configuration, wheel configuration, and drive system which enable the vehicle to automatically right itself from any position when it rolls over during operation thereof.

Figure 1:
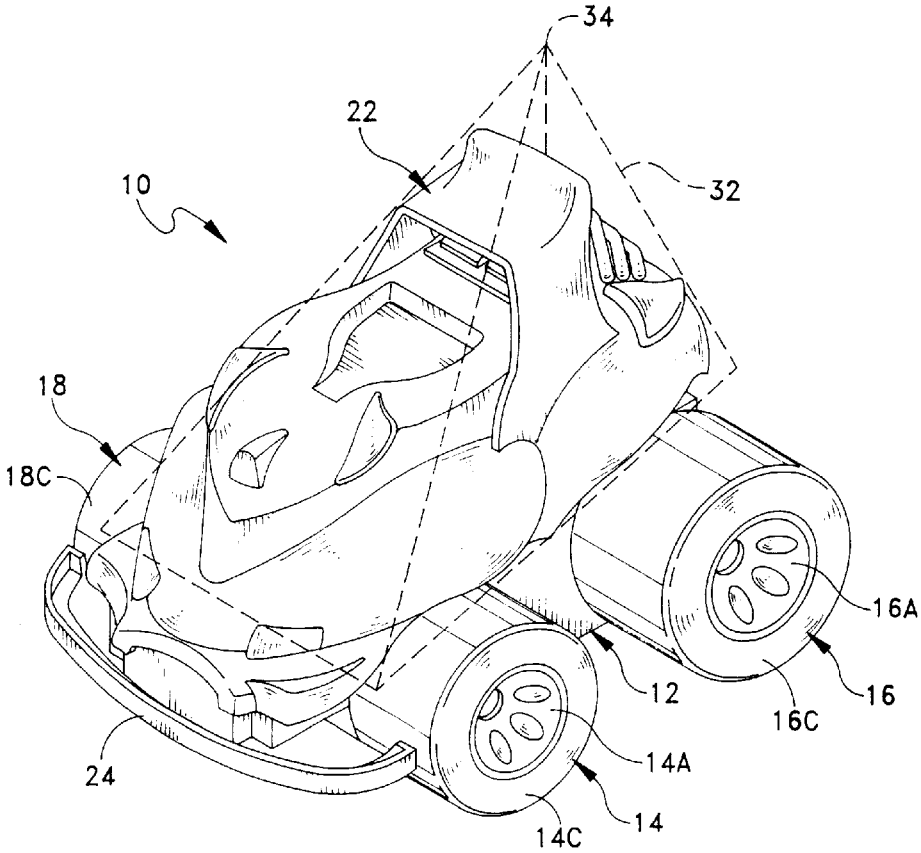
FIG. 1 is a perspective view of a first preferred embodiment of a self-righting remote control vehicle in accordance with the invention.

More specifically, as shown in FIG. 1, a first preferred embodiment of the self-righting remote control toy vehicle 10 generally comprises a chassis generally indicated at 12, four drive wheels generally indicated at 14, 16, 18 and 20 respectively, and a contoured body generally indicated at 22.

The chassis 12 is formed in a generally rectangular configuration having front and rear ends and opposing left and right side portions. The chassis 12 further includes a rounded bumper portion 24 integrally formed with the front end thereof. Still further, the upper side of the chassis 12 is provided with a battery holder assembly generally indicated at 26 for receiving a rechargeable battery 28. A printed circuit assembly 30 integrating various electronic assemblies to be described hereinafter is mounted to the upper side of the chassis 12 adjacent to the battery holder 26.

The body 22 is contoured to simulate a fanciful or futuristic body structure and it is received and secured on top of chassis 12 by conventional threaded fasteners (not shown). Referring to FIGS. 1, 2 and 3, the body 22 as herein illustrated is further configured in a generally pyramidal shape (see broken lines 32) having an apex 34 positioned on the longitudinal centerline 36 (FIG. 3) of the body 22 adjacent to a rear end of the body 22. The generally pyramidal body configuration as depicted by lines 32 in the drawings, effectively enables the vehicle 10 to roll over onto one of its sides when it is rolled over during operation thereof. However, alternatively, various other upwardly tapering body configurations, such as hemispherical configurations, which are adapted to prevent the vehicle 10 from coming to rest in a position in which none of the wheels 14, 16, 18 and 20 contact a supporting surface, are suitable for the body 22.

Paired sets of front and rear wheels 14, 16 and 18, 20 are rotatably mounted on the left and right sides of the chassis 12 to rotatably support the chassis 12 above a supporting surface 36. More specifically, each of the wheels 14, 16, 18, 20 comprises a rigid plastic rim portion 14A, 16A, 18A, 20A having a central hub 14B, 16B, 18B, 20B which is rotatably mounted on the end of a shaft extending through the chassis 12, and further comprises an outer rubber tread portion 14C, 16C, 18C, 20C for frictionally engaging the supporting surface 36. The rear wheels 16, 20 are rotatably mounted on a first shaft 38 adjacent the rear end of the chassis 12, while front wheels 14, 18 are rotatably mounted on a second shaft 40 adjacent the front end of the chassis 12. While the front wheels 14, 18 are commonly mounted to shaft 40 and rear wheels 16, 20 are commonly mounted to shaft 38, it is to be understood that wheels 14, 18, and 16, 20 are nevertheless independently rotatable with respect to each other. The rear wheels 16, 20 may be configured such that they have a larger diameter and larger width than the front wheels 14, 18. Furthermore, each of the wheels 14, 16, 18, 20 has peripheral portions which extend beyond the lower side and rear edge margins of the body (FIGS. 2 and 3) such that when the vehicle 10 or 110 is rolled over onto its body portion, a peripheral portion of at least one of the wheels always engages-the-supporting surface (See FIGS. 7 and 8).

The vehicle 10 further includes two separate drive systems generally indicated at 42, 42' respectively (FIG. 5), for rotatably driving left and right pairs of front and rear wheels 14, 16, and 18, 20, and still further includes a remote control receiver 46 for receiving control signals from a remote control transmitter 48 and a controller 50 for selectively independently controlling the separate drive systems 42, 42' responsive to the control signals received. More specifically, each of the drive systems 42, 42' comprises a reversible electric drive motor 52 and an associated gear train coupling the particular drive motor 52 to its respective pair of front and rear wheels for drivably rotating said wheels. Each of the gear trains comprises a drive gear 54 mounted on the drive shaft 56 of the motor 52, a reduction gear 58 intermeshed with the drive gear 54 for reducing rotation of the drive motor 52 to an acceptable speed, and two transfer gears 60, 62 intermeshed with the reduction gear 58 for transferring rotation to the paired front and rear wheels. In this connection, the hub of each wheel 14, 16, 18, 20 includes a gear surface 14D, 16D, 18D, 20D which intermeshes with a respective transfer gear 60, 62 for rotation thereof. It can thus be appreciated that rotation of the drive gear 54, 54' effectively causes simultaneous rotation of the associated front and rear wheels, either 14, 18 or 16, 20. As stated previously, each of the drive motors 52, 52' is a reversible drive motor, such that the wheels 14, 16, 18, 20 are rotatable in both clockwise and counterclockwise directions for both forward and backward movement of the vehicle 10.

The battery 28 is operable for energizing the first and second drive motors 52, 52', the remote control receiver 46 and the controller 50 for selectively in dependently energizing the drive motors 52, 52' responsive to the control signals received. The battery 28, battery holder 26, battery holder terminals 64, 66 (FIG. 4), and electrical connections from the battery holder terminals 64, 66 to the above-noted electronics (circuit board 30) are well known in the art, and therefore will not be further described herein. Furthermore, the remote control transmitter 48, remote control receiver 46 and controller 50 are conventional in the art, and therefore the specific construction and operation thereof will not be further described herein.

In operation, the vehicle 10 operates in a manner similar to a track laying vehicle wherein the left and right wheel pairs 14, 16 and 18, 20 are independently rotatable. However, the wheels are not connected by a tread. The vehicle 10 is thus operable for movement in both forward and rearward direction and for quick turning and maneuvering. The vehicle is quite agile and stable, but is nevertheless prone to bounding and rolling over when it is crashed into objects. However, the vehicle still is operational in the rolled over condition. As stated previously, the configuration of the body style 22 is such that when the vehicle is rolled over (FIG. 7), it normally rolls over onto one of its sides such that a peripheral portion of at least one of the wheels is always in engagement with the supporting surface 36. In this regard, the wheel or wheels which are in engagement with the supporting surface are operable for causing movement of the vehicle while on its side. Depending upon the surface there may be times when the vehicle is temporarily able to be precariously balanced without a wheel contacting the surface. However, upon actuation of either the left or right wheels, or both sets, the vehicle 10 thereafter rolls to a more stable position whereby at least one wheel contacts the surface. Subsequently, when the vehicle is put into motion, both of the front and rear wheels, either 14, 18 or 16, 20 come into engagement with the supporting surface 36 causing the vehicle to wobble, vibrate, or spin, thereby causing the vehicle to right itself during movement. While it is specifically indicated in the embodiment herein set forth that the rear wheels 16, 20 are larger than the front wheels 14, 18, it is to be understood that the wobbling effect is enhanced by the differing sizes of the paired front and rear wheels. Accordingly, any wheel configuration wherein the front and rear wheels have different diameters or widths would be effective to enhance the above-described effect, although it is not essential to utilize wheels of different sizes.

Figure 7:
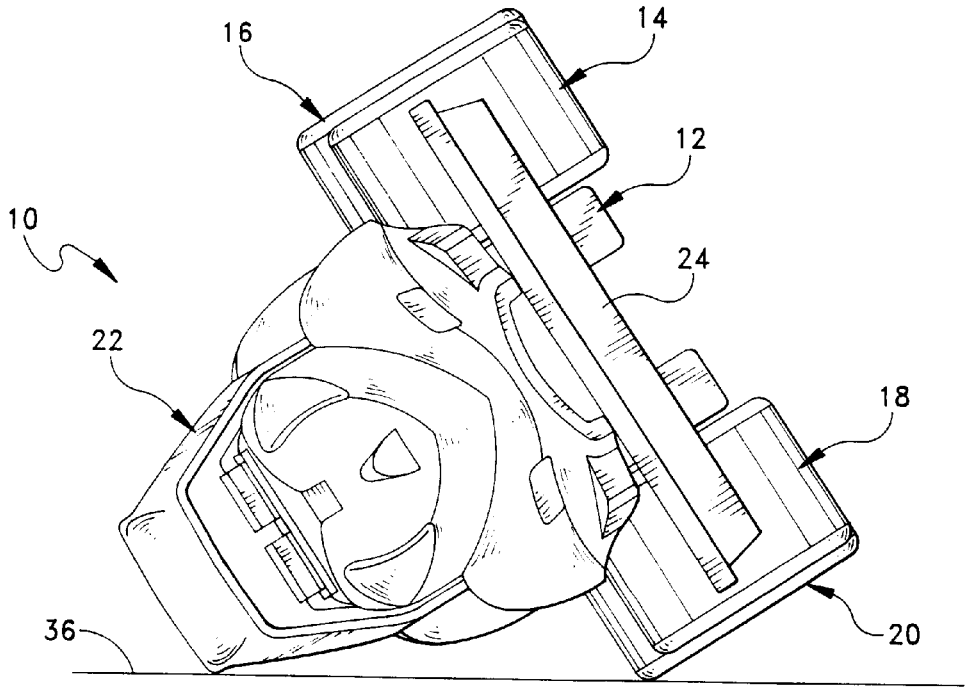
FIG. 7 is an environmental view of the vehicle of FIG. 1, with the vehicle rolled over onto its side to show the side wheels engaging the supporting surface.
Figure 8:
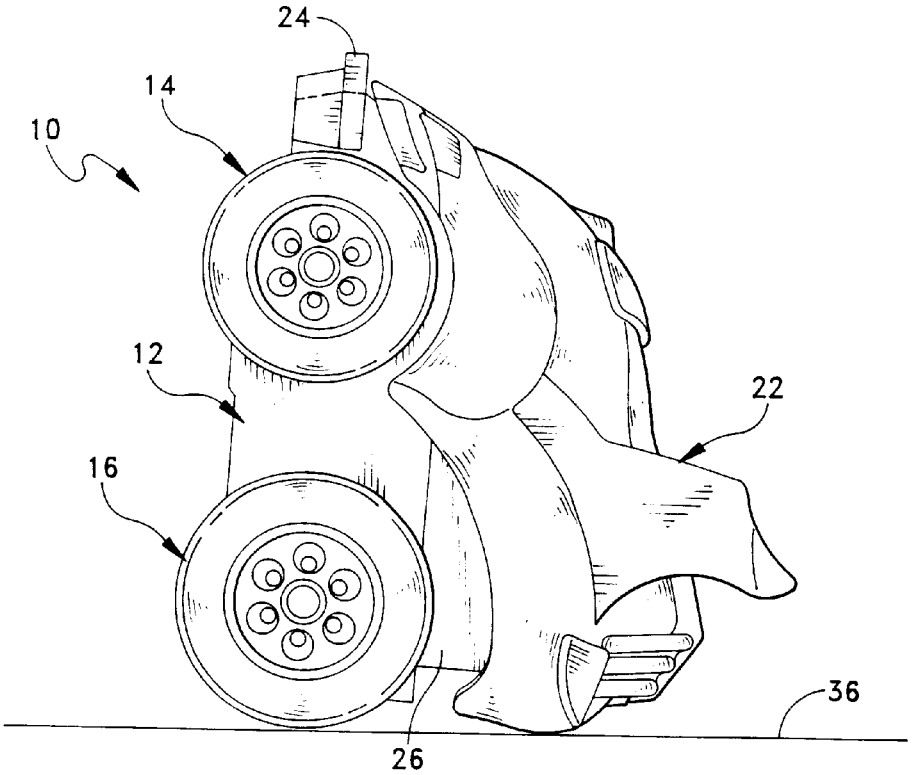
FIG. 8 is another environmental view of the vehicle of FIG. 1, with the vehicle tipped upright to show both rear wheels engaging the supporting surface.

Referring to FIG. 7, the vehicle 10 is also operational when it is upended on its rear end. In this regard, both of the rear wheels 16, 20 are in engagement with the supporting surface 36.

It can therefore be seen that the instant invention provides a unique and novel remote control vehicle which is effective for righting itself when rolled over during operation. The unique combination of the upwardly tapering configuration of the body 22, which prevents the vehicle from coming to rest without at least one of the wheels 14, 16, 18 and 20 in contact with a supporting surface, and the use of independent drive motors 52, 52' for driving the paired front and rear wheels, provides a unique mode of operation wherein the vehicle always has a portion of a wheel in engagement with the supporting surface 36 when rolled over, and further wherein the vehicle is operable for automatically righting itself when rolled over on its side. For these reasons, the instant invention is believed to represent a significant advancement in the art which has substantial commercial merit.

FIGS. 9–12 show a self-righting remote control toy vehicle 110 in accordance with a second preferred embodiment of the invention. More specifically, the vehicle 110 generally comprises a chassis 112, four drive wheels generally indicated at 114, 116, 118 and 120, respectively, and a contoured body generally indicated at 122.

Figure 9:
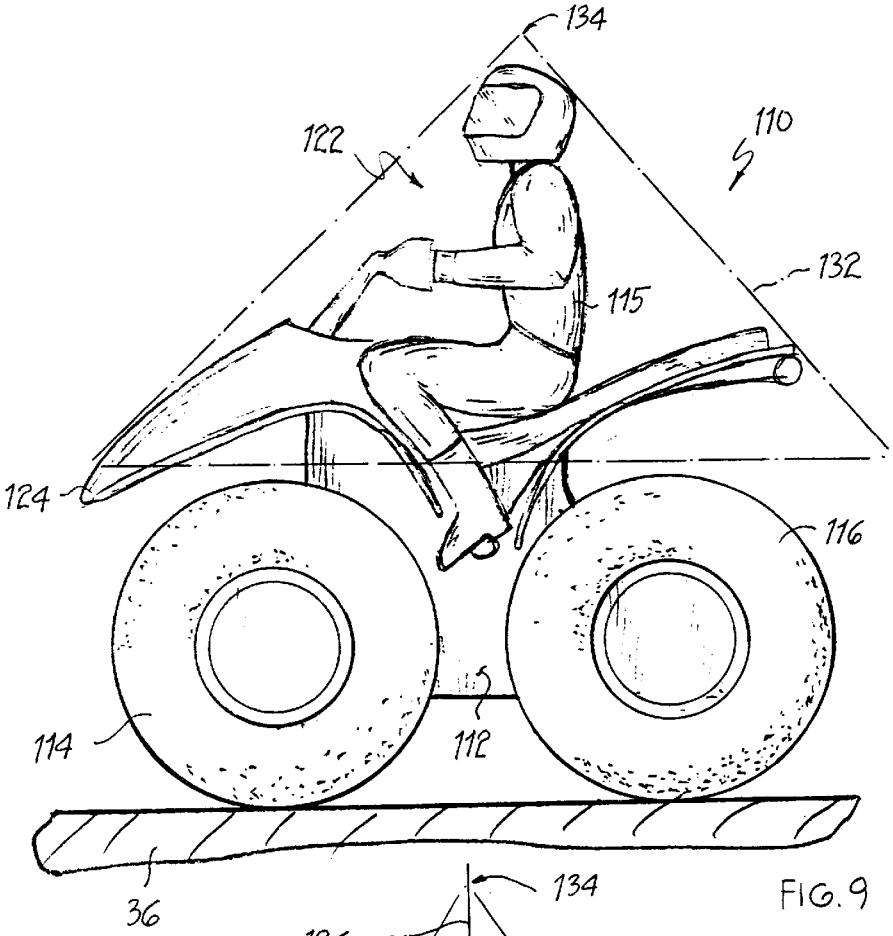
FIG. 9 is a side view, similar to FIG. 2, of a second preferred embodiment of a self-righting remote control vehicle constructed in accordance with the invention.
Figure 10:
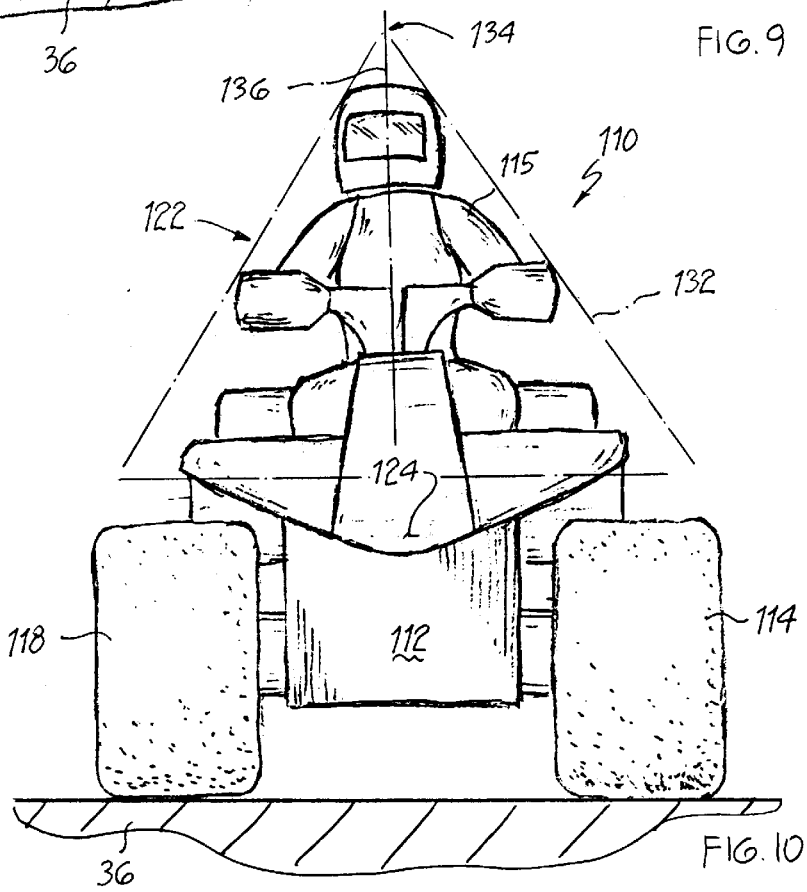
FIG. 10 is a front view of the vehicle shown in FIG. 9.
Figure 11:
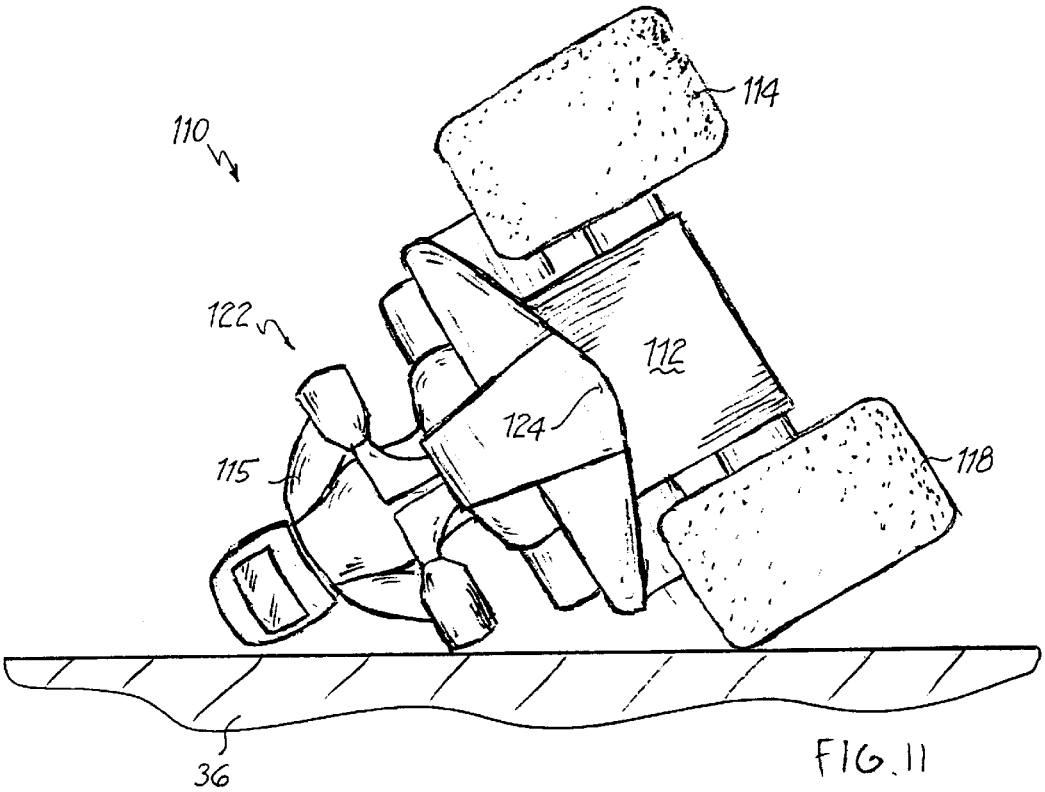
FIG. 11 is an environmental view of the vehicle shown in FIG. 9, with the vehicle rolled over onto its side to show side wheels engaging the supporting surface.
Figure 12:
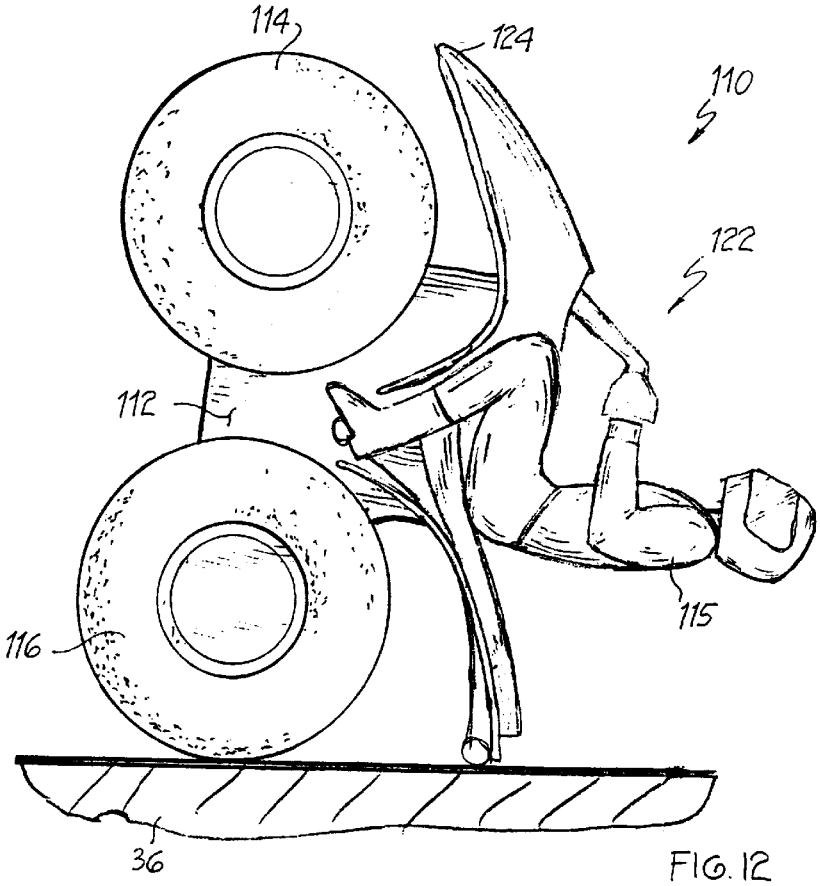
FIG. 12 is another environmental view of the vehicle shown in FIG. 9, with the vehicle tipped upright to show the rear wheels engaging the supporting surface.

The chassis 112 is generally similar in overall shape to that of the first preferred embodiment. That is, the vehicle 110 has a generally pyramidal shape with an apex. A rounded bumper portion 124 is integrally formed at a front end of the body 122. The body 122 is generally contoured to look like the shape of a FIG. 115 riding an all terrain type vehicle 110. The FIG. 115 is received and secured on top of the chassis 112 in any suitable mechanically fastened manner, as for instance, conventional threaded fasteners (not shown). Referring to FIGS. 9, 10 and 11, the body 122 as herein illustrated is further configured in a generally pyramidal shape (see broken lines 132) having an apex 134 positioned on the longitudinal centerline 136 (in FIG. 10) of the body 122. In general, the head of the FIG. 115 is located at the apex 134. This generally pyramidal body configuration, as depicted by lines 132 in the drawings, effectively enables the vehicle 110 to normally roll over onto one of its sides when it is rolled over during operation thereof, and to prevent the vehicle 110 from coming to rest in a position in which none of the wheels 114, 116, 118 and 120 contacts a supporting surface 36. In that functional and structural respect, the vehicle 110 of the second preferred embodiment is identical to the vehicle 10 of the first preferred embodiment. The only real difference relates to the structural aesthetics, because the vehicle 110 looks different than vehicle 10.

While there is shown and describe herein certain specific structures embodying the invention, it will be manifest to those skilled in the art that various other modifications and rearrangements of the parts may be made without departing from the spirit and scope of the underlying inventive concept and that the same is not limited to the particular forms herein shown and described except insofar as indicated by the scope of the appended claims.

It should be understood that the embodiments of the present invention shown and described in the specification are only preferred embodiments of the inventor who is skilled in the art and are not limiting in any way. Therefore, various changes, modifications or alterations to these embodiments may be made or resorted to without departing from the spirit of the invention and the scope of the following claims.

What is claimed is:

1. A self-righting remote control vehicle comprising:

a chassis;

front and rear wheels rotatably mounted on each of the respective left and right sides of the chassis for rotatably supporting the chassis on a supporting surface the vehicle having no other wheels;

a body mounted to the chassis including a lower edge margin and having a generally pyramidal shape which tapers to an uppermost apex above said wheels, the body being balanced such that when the vehicle is rolled over, it tends to roll toward one side thereof wherein a portion of at least one of said wheels engages said supporting surface and said lower edge margin does not contact said supporting surface;

a first drive for drivably rotating the front and rear wheels on the left side of the chassis;

a second drive for drivably rotating the front and rear wheels on the right side of the chassis;

a receiver for receiving control signals from a remote control transmitter; and a controller operatively connected to the receiver for selectively and independently controlling said first and second drives responsive to said control signals, said vehicle being operational so that when it rolls over toward said apex, said body may initially contact said supporting surface without any of said wheels in contact with said supporting surface but whereby operation of at least one of said first and second drives eventually causes sufficient movement of said vehicle to return said vehicle to a position wherein at least one wheel thereof engages said supporting surface and thereafter to an upright position in which it is supported on all four wheels.

2. The self-righting remote control vehicle of claim 1 wherein each of said wheels has a peripheral portion which extends outwardly beyond the lower edge margin of the body.

3. The self-righting remote control vehicle of claim 1 wherein said rear wheels have a larger dimension than said front wheels.

4. The self-righting remote control vehicle of claim 3 wherein rear wheels have a larger diameter and larger width than said front wheels.

5. The self-righting remote control vehicle of claim 1 wherein the body is in the form of a human figure riding on an all terrain vehicle and a head of the human figure forms the apex of the pyramidal shape.

6. The self-righting remote control vehicle of claim 1 wherein each of said drives is operable for drivably rotating said wheels in clockwise and counterclockwise directions.

7. The self-righting remote control vehicle of claim 6 wherein each of said drives comprises a reversible electric drive motor and a gear train coupling the drive motor thereof to the paired front and rear wheels thereof for drivably rotating said paired front and rear wheels, said vehicle further comprising a power source for energizing said first and second drive motors wherein said controller for independently controlling said drives is operative for selectively independently energizing said first and second drive motors.

8. The self-righting remote control vehicle of claim 1 wherein the apex is not located midway between the front and rear wheels.

9. The self-righting remote control vehicle of claim 8 wherein the apex is located closer to the rear wheels than the front wheels.

10. A self-righting remote control vehicle comprising:

a chassis;

front and rear wheels rotatably mounted on each of the respective left and right sides of the chassis for rotatably supporting the chassis on a supporting surface the vehicle having no other wheels;

left and right drives for drivably controlling the left and right wheels, respectively, in forward or reverse motion; and a body mounted to the chassis, the body including a lower edge margin and also having a generally pyramidal shape which tapers to an uppermost apex above said wheels such that when the vehicle rolls over toward said apex, said body may initially contact said supporting surface without any of said wheels in contact with said supporting surface, it thereafter tends to rock back onto one side thereof wherein a portion of at least one of said wheels engages said supporting surface and said lower edge margin does not contact said supporting surface upon actuation of at least one of the left and right drives, said actuation eventually enabling the vehicle to be remotely controlled to cause it to self-right such that all four wheels contact the supporting surface.

11. The self righting remote control vehicle of claim 10 wherein the body is in the form of a human figure riding on an all terrain vehicle and the head of the human figure forms the apex of the pyramidal shape.

12. The self-righting remote control vehicle of claim 10 wherein each of said wheels include a peripheral portion which extends outwardly beyond the lower edge margin of the body.

* * * * *

UNITED STATES PATENT AND TRADEMARK OFFICE

CERTIFICATE OF CORRECTION

PATENT NO. : 6,129,607
DATED : October 10, 2000
INVENTOR(S) : Michael G. Hoeting; Sean T. Mullaney It is certified that error appears in the above-identified patent and that said Letters Patent is hereby corrected as shown below:

Column 2,
Line 23, "...drive system, and..." should read --...drive system; and ... --

Column 4,
Line 9, "engages-the-supporting surface" should read -- engages the supporting surface --.
Line 41, "for selectively in depently" should read -- selectively independently. --

Column 5,
Lines 51, 52 and 59, "FIG. 115" should read -- Figure 115 --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*